US007600636B2

(12) United States Patent
Bell

(10) Patent No.: US 7,600,636 B2
(45) Date of Patent: Oct. 13, 2009

(54) CLOTHES PROTECTOR COVER

(76) Inventor: Patricia Bell, P.O. Box 2998, Duluth, GA (US) 30096

( * ) Notice: Subject to any disclaimer, the term of this patent is extended or adjusted under 35 U.S.C. 154(b) by 219 days.

(21) Appl. No.: 11/328,812

(22) Filed: Jan. 10, 2006

(65) Prior Publication Data

US 2007/0068980 A1 Mar. 29, 2007

Related U.S. Application Data

(60) Provisional application No. 60/596,497, filed on Sep. 28, 2005.

(51) Int. Cl.
*A41D 27/22* (2006.01)
*B65D 85/18* (2006.01)

(52) U.S. Cl. ..... 206/286; 206/278; 206/279; 206/527; 211/180; 223/96

(58) Field of Classification Search ..... 206/285–287, 206/278, 279, 527; 150/154; 211/180; 223/85, 223/98; 312/3
See application file for complete search history.

(56) References Cited

U.S. PATENT DOCUMENTS

| | | | | | |
|---|---|---|---|---|---|
| 1,097,544 | A | * | 5/1914 | Goldberg | 206/280 |
| 1,136,346 | A | * | 4/1915 | Krebs | 206/287 |
| 1,314,608 | A | * | 9/1919 | Roach | 206/287 |
| 1,611,584 | A | * | 12/1926 | Farkash et al | 206/287 |
| 2,026,464 | A | * | 12/1935 | Fleischer | 223/98 |
| 2,278,185 | A | * | 3/1942 | Pearson | 206/280 |
| 2,351,882 | A | * | 6/1944 | Schwartzman | 206/287 |
| 2,462,966 | A | * | 3/1949 | Maynard, Sr. et al. | 206/287 |
| 4,140,163 | A | * | 2/1979 | Usner | 383/22 |
| 4,236,634 | A | * | 12/1980 | Benedict | 206/287 |
| 5,078,668 | A | | 1/1992 | Endres | |
| 5,564,577 | A | | 10/1996 | Knaggs | |
| 5,697,508 | A | * | 12/1997 | Rifkin et al. | 211/162 |
| 5,788,067 | A | * | 8/1998 | Marcellis | 206/280 |
| D427,782 | S | | 7/2000 | St. L-Morency | |
| 6,499,636 | B1 | | 12/2002 | McCool | |
| 6,811,027 | B2 | | 11/2004 | Alexander | |
| 2002/0071618 | A1 | * | 6/2002 | Felsenthal | 383/39 |

OTHER PUBLICATIONS

SEARS.COM—Item No. 00850330000, Mfg. Model No. 7462389WM; Internet; Jan. 9, 2005.
ALCOSALES.COM—Part No. AL-51324; Internet; Jan. 9, 2005.
HANGERCITY.COM—Item No. 8113910; Internet; Jan. 9, 2005.

* cited by examiner

*Primary Examiner*—Sue A Weaver
(74) *Attorney, Agent, or Firm*—Williamson Intellectual Property Law, LLC; Thomas R. Williamson, III

(57) ABSTRACT

The present invention provides a new and useful clothes protector cover comprised of a rectangular left sheet, a rectangular right sheet, and a plurality of grommets located on the upper edge of each of the sheets. A clothes hanger, upon which an item of clothing may already be hung, is threaded through a grommet on the left sheet and a corresponding grommet on the right sheet and hung on the hanger bar. This is repeated throughout the length of the sheets until all items of clothing are hung on the hanger rod and thereby protected by the clothes protector cover. This provides a means by which the clothes protector cover is held in place immediately above the protected items of clothing and thereby prevents the accumulation or settling of dust on the items of clothing.

12 Claims, 14 Drawing Sheets

CLOTHES PROTECTOR COVER

CROSS-REFERENCE TO RELATED APPLICATION(S)

The present non-provisional patent application claims the benefit of priority of U.S. Provisional Patent Application No. 60/596,497, filed Sep. 28, 2005, and entitled "SIMPLE CLOTHES PROTECTOR COVER," which is incorporated in-full by reference herein.

FIELD OF THE INVENTION

The present invention relates generally to the field of clothing protection. More specifically the present invention relates to a clothes protector cover and an improved means for protecting clothing in a closet or other storage area from dust, particulate matter, and the like.

BACKGROUND OF THE INVENTION

When items such as clothing or the like are hung from a rod or bar in a closet or other similar storage area, dust inevitably settles on the hanging items. Such dust is unsightly and may even cause permanent damage to the clothing. Furthermore, once the clothing is soiled with dust, the owner of the clothing may be required to use the services of a professional cleaner to return the clothing to its normal, clean state. This can become costly when numerous articles of clothing become soiled by dust.

In the prior art, many devices have been disclosed for protecting items of clothing from dust, particulate matter, or the like. Various dust protective measures exist in which items of clothing are individually protected in a garment bag or a protective sleeve. Other protective means include the use of sheets or covers draped over an entire closet area.

The measures in the prior art which protect only an individual item of clothing are limited in that one would need to use many such devices to properly cover all items of clothing in a closet. Additionally, such an endeavor is time consuming since each individual item of clothing must be contained in an individual garment protector. Furthermore, the time required to simply remove an article of clothing from the closet would greatly increase. To do so also would become costly since there is an associated cost for each individual garment bag.

The measures in the prior art that include draping sheets over the closet area are overly burdensome. Additionally, such an apparatus is usually located several inches above the clothing desired to be protected and still allows for the circulation of air and the dust flowing freely in it to settle upon articles of clothing.

These and other problems exist. Previous attempts to solve these and other problems include the following:

U.S. Pat. No. 6,499,636, issued to McCool on Dec. 31, 2002, discloses an improved clothing protector comprising a cover for clothes hangers shaped to slip over the hook of the hanger and to be supported by the wings of the hanger. The clothing protector is comprised of two panels of foam material, such as polyurethane, leaving a space to receive the hook of the hanger, and formed with a slip-resistant surface. After joining, the panels to tend to flare out, providing an area for supporting an article of clothing. However, this clothing protector is placed over or upon a clothing hanger, not over an article of clothing already on a hanger, and is thus really only a hanger cover, not a clothing cover.

U.S. Design Pat. No. Des. 427,782 issued to St. L-Morency on Jul. 11, 2000 discloses the ornamental design for a clothes protector for a hanger.

U.S. Pat. No. 5,564,577, issued to Knaggs on Oct. 15, 1996, discloses an apparatus for protecting clothes hanging on a hanger bar in a closet from dust. The apparatus employs an elongated roller assembly that is provided with an extensible and retractable, preferably transparent, sheet member and also at least one elongated rod-like member. However, this protective apparatus remains above the hanger bar and any clothing. Clothes hangers holding items of clothing are not threaded through the sheet comprising the protective cover. Thus, this apparatus is more like a retractable shade, curtain, or blind over items of clothing located in a closet.

U.S. Pat. No. 6,811,027, issued to Alexander on Nov. 2, 2004, discloses a polyethylene garment protector, extensively used by garment manufacturers to protect garments in transport to and from various facilities such as factories, distribution centers, and retail establishments. However, this garment protector is for use with an item of clothing in transit, not for use in a closet or the like, wherein the entire clothing contents are desired to be covered by a protective apparatus.

U.S. Pat. No. 5,078,668 to Endres on Jan. 7, 1992, discloses a method of making a garment protector that is of high quality, having an envelope structure made of cloth fabric with an easy access opening in one of its sides covered by a flap member. However, this garment protector is for use with an individual item of clothing, and is not designed for use to cover the entire clothing contents of a closet.

U.S. Pat. No. 5,697,508 to Rifkin on Dec. 16, 1997, discloses a method of protecting garments during transportation by shrouding the garments. This method may be considered practical for transporting garments in the garment trade, but would not be practical in the day-to-day use in selecting clothes from an individual's closet since the clothing is completely enclosed from the bottom up. To remove clothing from this type of system would be very cumbersome on a day-to-day basis.

U.S. Pat. No. 5,788,067 to Marcellis on Aug. 4, 1998, discloses a gift wrap garment bag that protects an individual item of clothing that hangs over the individual clothes hanger. While this is practical for protecting an individual piece of clothing, it is not practical for protecting a plurality of garments in a clothes closet with easy access on a daily basis.

U.S. Pat. No. 2,026,464 to Fleischer on Dec. 31, 1935, discloses a garment protector for individual items of clothing. While this is practical for protecting an individual piece of clothing it is not practical for protecting a plurality of garments in a clothes closet with easy access on a daily basis.

U.S. Pat. No. 7,124,884 B2 to Felsenthal on Oct. 24, 2006, discloses a garment protector system for completely enclosing garments and including a means of incorporating a pocket for chemical protection of the garment(s). While this is practical for a chemical protection of moths and the like for long-term storage, it is not a practical application for protecting a plurality of garments to be used on a daily basis from dust.

U.S. Pat. No. 1,611,584 to Farkash and Rosenthal on Dec. 21, 1926, discloses a garment bag with a side opening for single garment. While this is a practical application for a minimal number of garments, it does not provide easy access and protection to a plurality of garments to be used on a daily basis from dust and the like.

U.S. Pat. No. 2,462,966 to Henry on Mar. 1, 1949 discloses a garment protection bag for long-term storage of a garment for protection from moths and the like, it is not a practical application for protecting a plurality of garments intended to be used on a daily basis from dust and the like.

U.S. Pat. No. 4,236,634 to Benedict on Dec. 2, 1980, discloses a garment protection system to protect a plurality of garments. While this is a practical application for long-term storage of a plurality of garments, it is not a practical application to protect a plurality of garments from dust and the like since it completely encloses the garments and does not provide for easy selection on a daily basis.

U.S. Pat. No. 1,097,544 to Goldberg on May 19, 1914, discloses a garment protector for individual items of clothing. While this is practical for protecting an individual piece of clothing, it is not practical for protecting a plurality of garments in a clothes closet with easy access on a daily basis.

U.S. Pat. No. 1,136,346 to Krebs on Apr. 20, 1915, discloses a garment protector for individual items of clothing. While this is practical for protecting an individual piece of clothing, it is not practical for protecting a plurality of garments in a clothes closet with easy access on a daily basis.

U.S. Pat. No. 4,140,163 to Usner on Feb. 20, 1979, discloses a method of protecting a plurality of garments shrouding the garment. This method may be considered practical for long-term protection of garments, but would not be practical in the day-to-day use in selecting clothes from an individual's closet since the clothing is completely enclosed from the bottom up. To remove clothing from this type of system would be very cumbersome on a day-to-day basis.

U.S. Pat. No. 2,351,882 to Schwartzman on Mar. 18, 1943, discloses a method of protecting a plurality of garments shrouding the garments. This method may be considered practical for long-term protection of garments, but would not be practical in the day-to-day use in selecting clothes from an individual's closet since the clothing is completely enclosed. To remove clothing from this type of system would be very cumbersome on a day-to-day basis and also cumbersome in viewing the desired garment for selection.

U.S. Pat. No. 1,314,608 to Roach on Sep. 2, 1919, discloses a method of protecting a plurality of garments shrouding the garments. This method may be considered practical for long-term protection of garments, but would not be practical in the day-to-day use in selecting clothes from an individual's closet since the clothing is completely enclosed. To remove clothing from this type of system would be very cumbersome on a day-to-day basis and also cumbersome in viewing the desired garment for selection.

U.S. Pat. No. 2,278,185 to Pearson on Mar. 31, 1942, discloses a garment protector for individual items of clothing. While this is practical for protecting an individual piece of clothing it is not practical for protecting a plurality of garments in a clothes closet with easy access on a daily basis.

Additionally, there are products in the marketplace that seek to provide a protective cover for clothing. For example, Sears, the major US retailer, sells a garment rack cover, item number 00850330000, manufacturer's model number 7462389WM, at http://www.sears.com/sr/javasr/product-.do?BV_SessionID=@@@@ 1606230013.113-5693 242@@@@&BV_EngineID=ccjladdgijfjedmcegecegjdghl dggo.0&vertical=SEARS&-sid=1009360005000450 0085& pid=00850330000. This cover is used to cover a mobile garment rack and protect the clothing contained within. Also, Alco Sales and Service sells a garment rack cover kit, part AL-51324, made of coated nylon, located online at http://www.alcosales.com/Alco/AlcoProd.nsf50dfebd4b26e 8d5f86256a140048fd-ce/f54d1878dcb203fd862569df0044 dd65!OpenDocument&Highlight=0,al-51321. The cover is also used to fit a mobile garment rack. HangerCity sells garment storage devices that hang from a rod in a closet. One such product is garment bag, product number 8113910, located online at http://www.hangercity.com/caclst.html. These are examples of a few of the many products sold that either cover individual garments in a garment protector or cover a mobile rack of garments in transport rather than cover an entire closet directly above the protected hanging articles of clothing.

While these patents and other previous devices and methods have attempted to solve the above mentioned problems, none have provided for a clothes protector cover in the same manner as the present invention. Therefore, a need exists for such a device and method of manufacture and use.

BRIEF SUMMARY OF THE INVENTION

In various embodiments, the present invention provides a new and useful clothes protector cover. The clothes protector cover is comprised of a rectangular left sheet, a rectangular right sheet, and a plurality of grommets located on the upper edge of each of the sheets.

In one exemplary embodiment, the grommets are located along the upper edge of each rectangular sheet. A clothes hanger, upon which an item of clothing may already be hung, is threaded through a grommet on the left sheet and a corresponding grommet on the right sheet and hung on the hanger bar. This is repeated throughout the length of the sheets until all items of clothing are hung on the hanger rod and thereby protected by the clothes protector cover. This provides a means by which the clothes protector cover is held in place immediately above the protected items of clothing and thereby prevents the accumulation or settling of dust on the items of clothing.

In another exemplary embodiment of the present invention, the clothes protector cover further includes one or more of various means by which the left sheet and right sheet can be fastened together when an item of clothing on a clothes hanger is not present and when an empty clothes hanger is not used to secure the left and right sheets together. These various means include the use of snap hook clasps, shower curtain hangers, ribbons, hanger hooks, cords, and the like.

In yet another exemplary embodiment of the present invention, a method of manufacturing and use of a clothes protector cover is described.

BRIEF DESCRIPTION OF THE DRAWINGS

The present invention is illustrated and described herein with reference to preferred embodiments and examples thereof, in which like reference numbers denote like parts or components, and in which.

DETAILED DESCRIPTION OF THE INVENTION

Before explaining the disclosed embodiments of the present invention in detail, it is to be understood that the invention is not limited in its application to the details of the particular arrangement shown since the invention is capable of other embodiments. Also, the terminology used herein is for the purpose of description and not of limitation.

Figure 1:
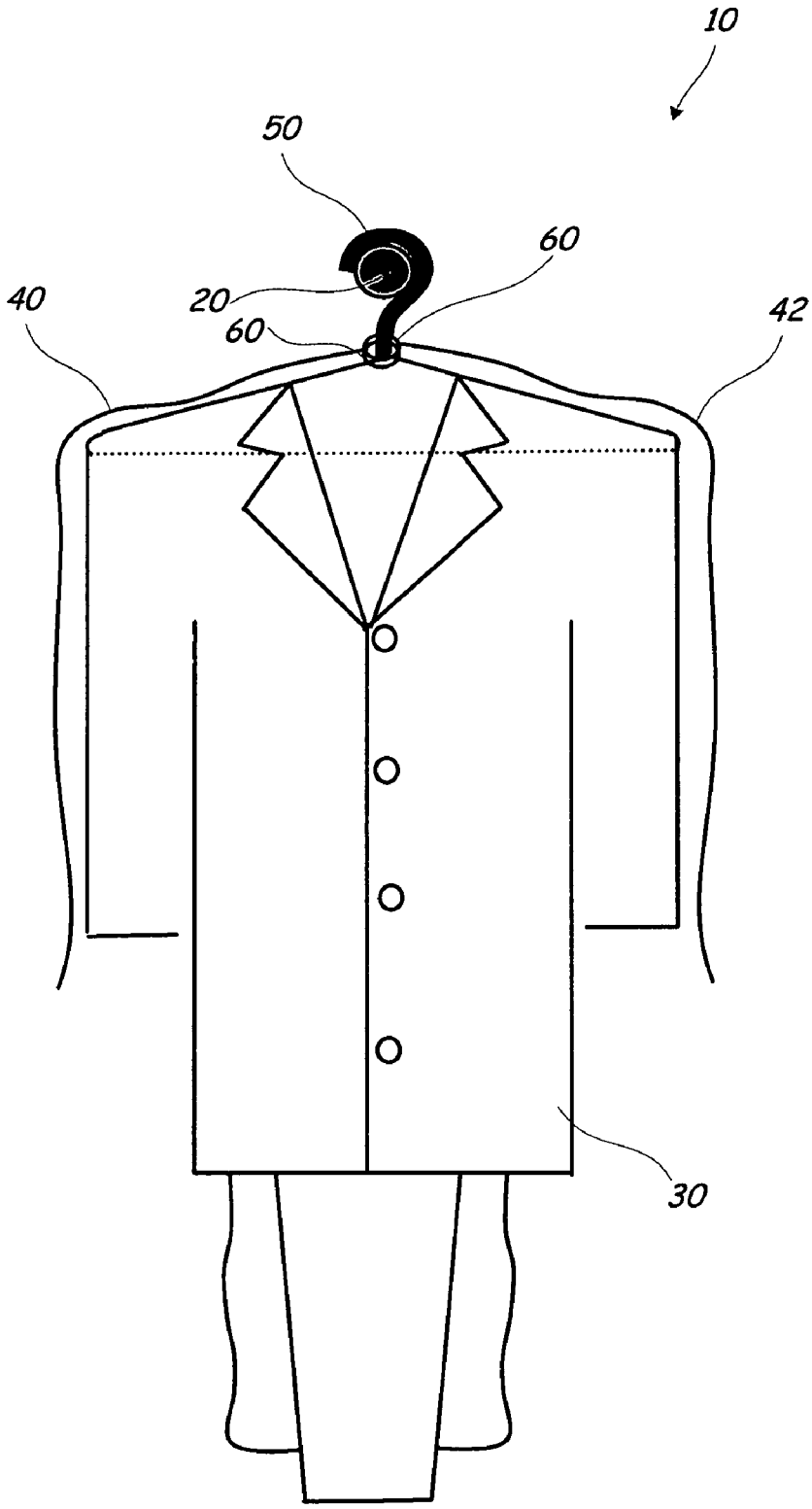
FIG. 1 is a side planar view of a clothes protector cover according to an embodiment of the present invention.

Referring now to FIG. 1, a side planar view of a clothes protector 10 is shown. The clothes protector cover 10 is comprised of a left sheet 40, a right sheet 42, and a plurality of grommets 60. The clothes protector cover 10 is shown upon a clothes hanger 50, which is placed upon a hanger rod 20. An item of clothing 30 is also shown hanging from the clothes hanger 50. The clothes protector cover 10 is used to protect hanger-suspended items of clothing hung from a horizontal hanger rod 20. The clothes protector cover 10 is used in closets, storage areas, or the like, wherein a generally horizontal hanger rod 20 is located.

The hanger rod 20 is a traditional cylindrical wooden dowel rod, or the like, common in many closets, but may be any generally horizontal means by which items of clothing may be hung. For example, many new closets and storage areas use wire-frame shelving, the underside from which hangers are placed.

The left and right sheets 40 and 42 are generally rectangular in shape, with a width of approximately twenty six inches and a length of approximately ninety inches. The width of a sheet 40 or 42 refers to the sheet direction from the base of the hook of the clothes hanger 50 along the shoulder of the clothes hanger 50 then in a downwardly vertical direction along the sleeve of side of an item of clothing in a direction toward the closet floor. The length of a sheet 40 or 42 refers to the distance along the horizontal direction of the sheet parallel to the hanger rod 20. These dimensions are representative of one embodiment of the present invention. Various widths and lengths may be used to manufacture the left and right sheets 40 and 42. Additionally, for larger closets, more than one clothes protector cover 10 may be used, coupling two or more pairs of sheets 40 and 42 together to form one continuous length of clothing protection.

The left and right sheets 40 and 42 are comprised of fabric, but may be made from a similar material. The various materials may include, but are not limited to, cotton, polyester, plastic, silk, or wool. The fabric is preferably transparent to allow for viewing of the items of clothing without the need to lift a sheet 40 or 42 for viewing. The fabric is preferably of a washable composition. Furthermore, the substance with which the sheets are made must be of a moderate or light weight so as to not compress or compromise the items of clothing located underneath. The edges of the fabric sheets 40 and 42 may be hemmed on all four sides in order to reinforce the edges and therefore prevent any fraying of the sheets 40 and 42 during washing or otherwise.

Each sheet 40 and 42 contains a plurality of grommets 60 installed along one edge of the side with the longer dimension. The grommets 60 are spaced along each sheet so that they will match when the two sheets 40 and 42 are placed side-by-side and such that a clothes hanger 50 or other clasp device will securely hold the two sheets 40 and 42 together. Preferably the grommets 60 are placed approximately fourteen inches apart; however, this distance may vary as needed. Additionally, the distance between the grommets 60 need not be uniform. The grommets 60 have an approximate inside diameter of seven sixteenths of an inch to accommodate both wire hangers as well as larger tubular hangers. The clothes protector cover 10 is installed such that a grommet 60 is positioned at each end along one length side of each sheet 40 or 42. Additional grommets 60 are then evenly placed between the two end grommets 60 on each sheet. Items of clothing on a clothes hanger 50 may be hung through the grommets 60 to help hold the clothes protector cover 10 in place or may be hung on the hanger rod 20 without being threaded through the grommets 60.

The clothes protector cover 10 is used by placing the left sheet 40 over the left shoulder of the clothes hanger 50, threading the clothes hanger through a grommet 60, placing the right sheet 42 over the right shoulder of the same clothes hanger 50 used for the left sheet 40, threading the clothes hanger through another grommet 60, and placing the clothes hanger on a hanger rod 20. The clothes protector cover 10 may also be used by installing the sheets 40 and 42 in reverse order. The left and right sheets 40 and 42 may also be installed by using one or more of the various, optional clasps as illustrated in FIGS. 8 through 13. Additionally, the left and right sheets 40 and 42 are easily placed into position upon the hanger rod 20 without removing the items of clothing from the hanger rod 20.

Figure 2:
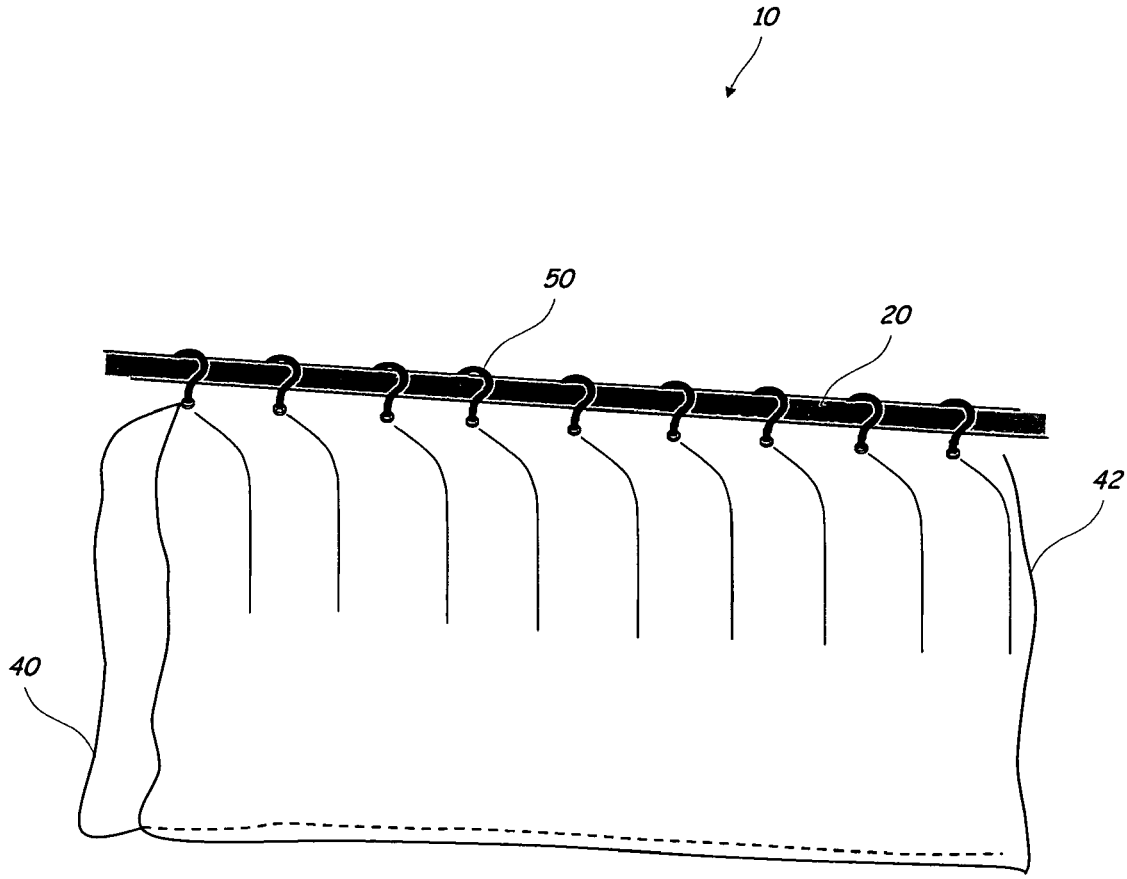
FIG. 2 is a side perspective view of a clothes protector cover according to an embodiment of the present invention.

Referring now to FIG. 2, a side perspective view of a clothes protector cover 10 is shown. The clothes protector cover 10 is shown along an entire length of a hanger rod 20 as it would be situated in a closet or similar storage area. The left sheet 40 and the right sheet 42 are shown draped across both sides of all of the items of clothing and threaded with a plurality of clothes hangers 50. The clothes protector cover 10 and the protected clothing are shown hanging from the hanging rod 20 on clothes hangers 50 which are placed through the grommets 60 prior to being hung on the hanger rod 50. The clothes hangers 50 support both the clothes protector cover 10 and all of the items of clothing.

Figure 3:
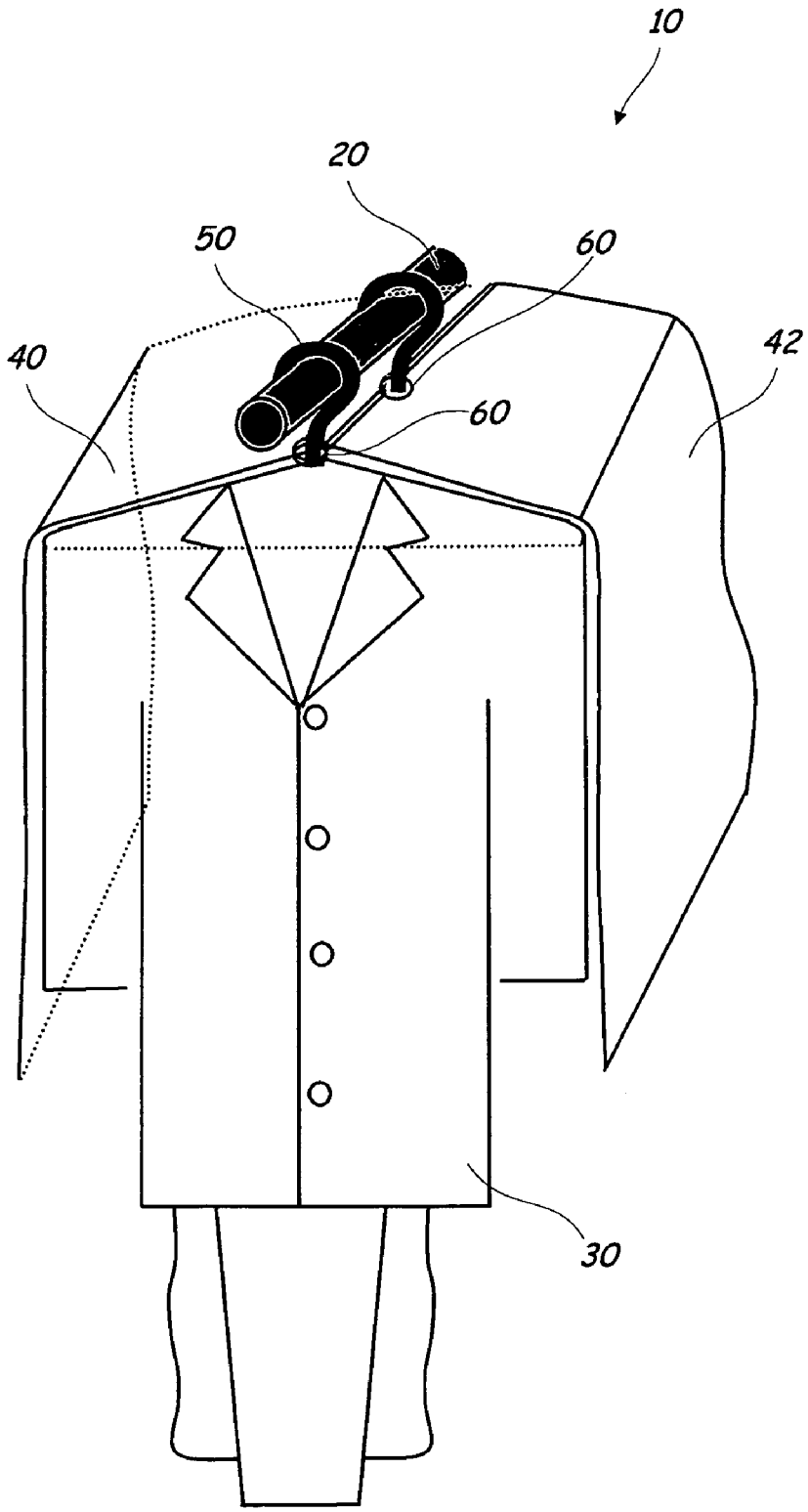
FIG. 3 is a side perspective view of a clothes protector cover according to an embodiment of the present invention.

Referring now to FIG. 3, a side perspective view of a clothes protector cover 10 is shown. The clothes protector cover 10 is shown on a hanger rod 20. The left sheet 40 and the right sheet 42 are shown draped across both sides of the hanging items of clothing 30. The clothes protector cover 10 and the items of clothing 30 are shown hanging from the hanging rod 20 on clothes hangers 50 which are threaded from the underside through the grommets 60 of the left and right sheets 40 and 42 of the clothes protector cover 10 before being placed on the hanger rod 20.

Figure 4:
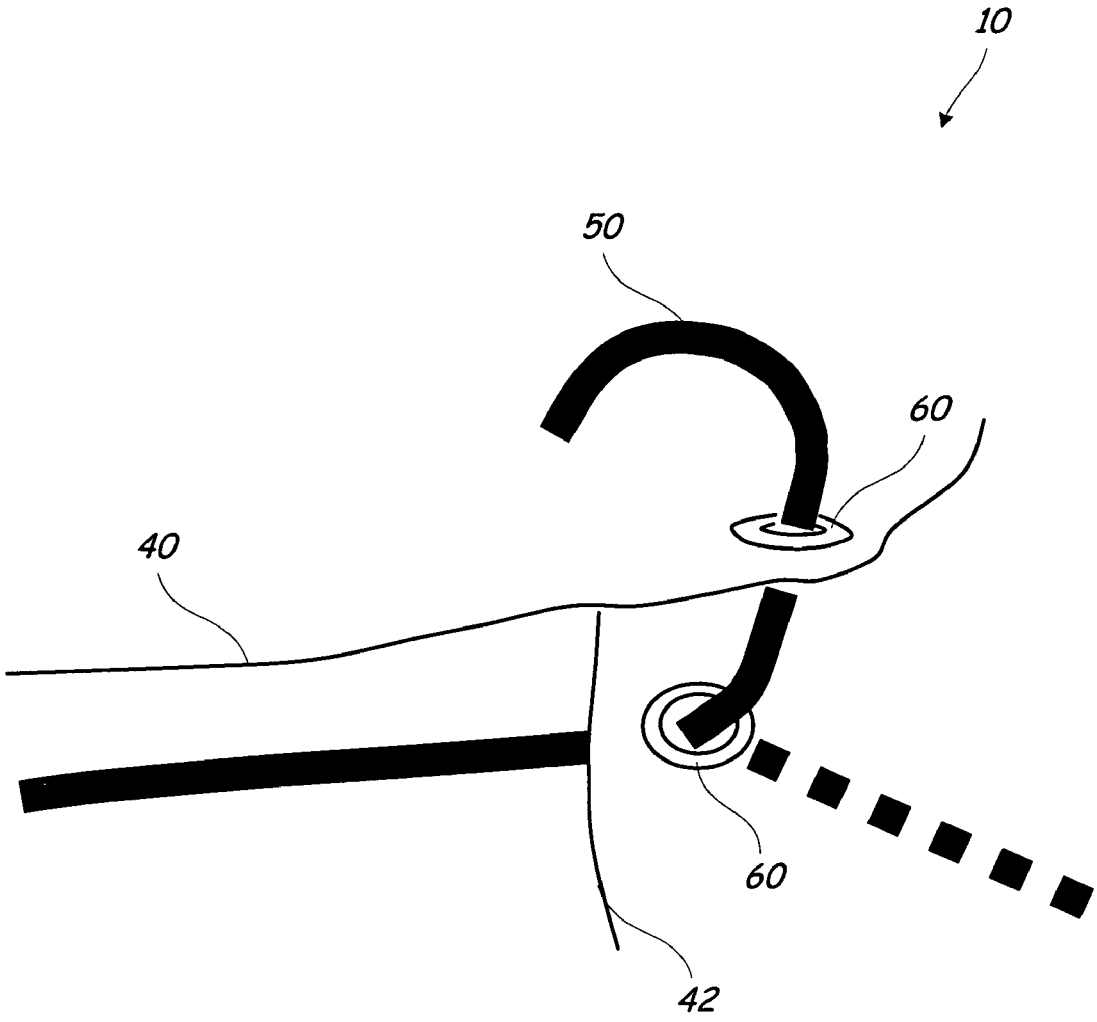
FIG. 4 is a top perspective view of a clothes protector cover according to an embodiment of the present invention.

Referring now to FIG. 4, a top perspective view of a clothes protector cover 10 is shown. The clothes protector cover 10 is comprised of a left sheet 40, a right sheet 42, and a plurality of grommets 60. A clothes hanger 50 is shown first threaded through a grommet 60 on the right sheet 42 and then threaded through a grommet 60 on the left sheet 40. This threading process is continued down the length of both the left sheet 40 and the right sheet 42, pairing the grommets 60 together in order with each inserted clothes hanger 50. Optionally, the sheets 40 and 42 could be threaded such that the left sheet 40 is placed over the clothes hanger 50 first. Each clothes hanger 50 may then be placed on a hanger rod to both hang an item of clothing and also to hold securely the clothes protector cover 10 in place.

Figure 5:
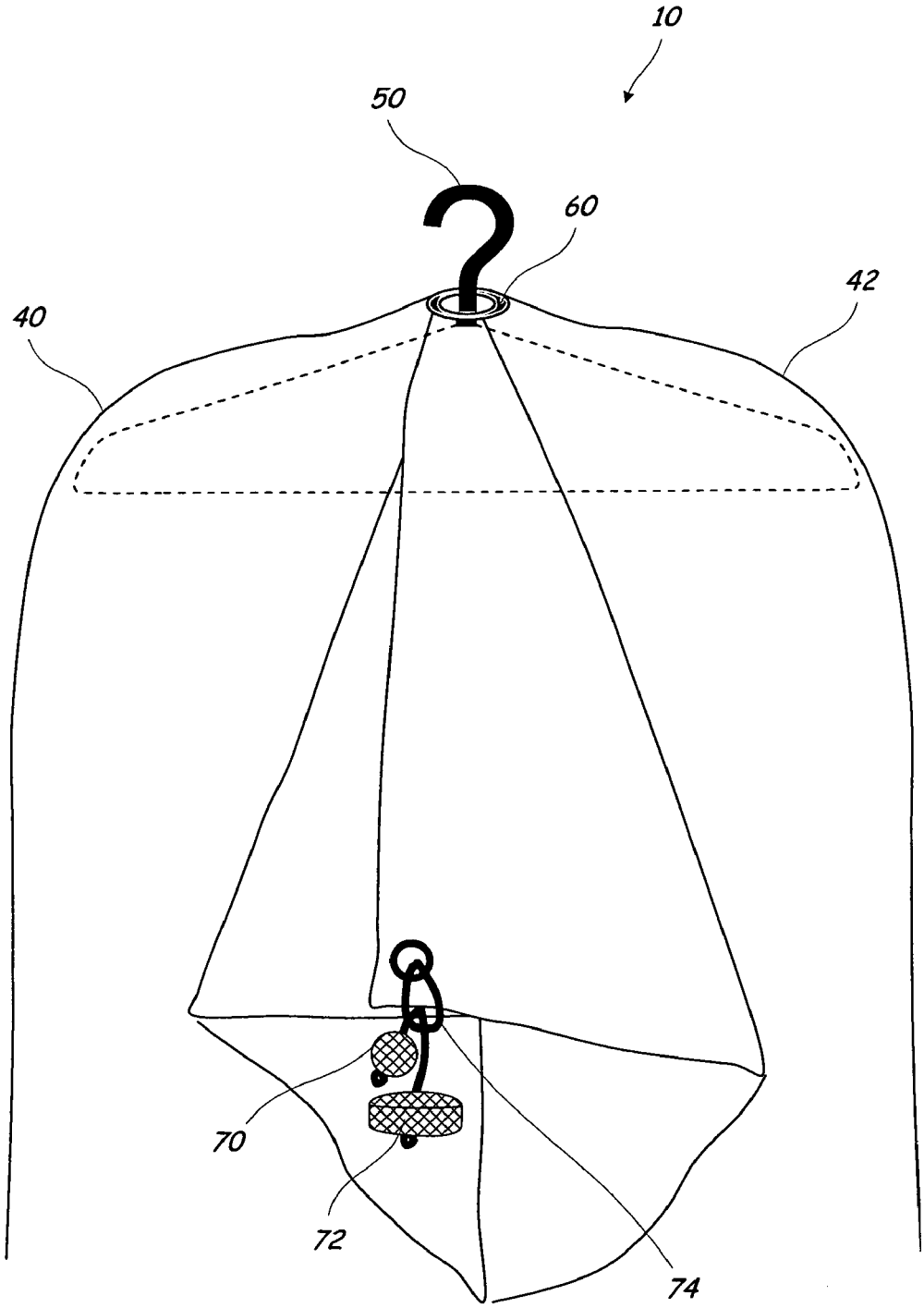
FIG. 5 is a side planar view of a clothes protector cover according to an embodiment of the present invention.

Referring now to FIG. 5, a side planar view of a clothes protector cover 10 is shown. The clothes protector cover 10 is comprised of a left sheet 40, a right sheet 42, and a plurality of grommets 60. The clothes protector cover 10 is shown here with the left and right sheets 40 and 42 extending down in a vertical direction protecting the front portion of the first item of clothing placed on a clothes hanger 50. At the opposite end of the clothes protector cover 10, the left and right sheets 40 and 42 also extend down in a vertical direction on the back side of the last item of clothing placed on a clothes hanger 50. This is an optional means of installing the clothes protector cover 10. The installation begins with the second grommet 60 of the two sheets 40 and 42 placed on the same clothes hanger 50 and continuing to install all of the grommets on clothes hangers 50 up until the next to last grommet of both sheets, leaving the last grommet 60 of each sheet 40 and 42 free from placing on a clothes hanger and hanging in a vertical direction to protect the back side of the last item of clothing. An optional cedar ball 70 or cedar disk 72, already available in the consumer market, may be placed on a cord 74 and threaded through the first grommet of the left sheet 40 and the first grommet of the right sheet 42 to further protect the clothing. The cedar ball 70 and the cedar disk 72 are aromatic and protect items of clothing by deterring moths from nesting in the clothing fabric such as wool.

Figure 6:
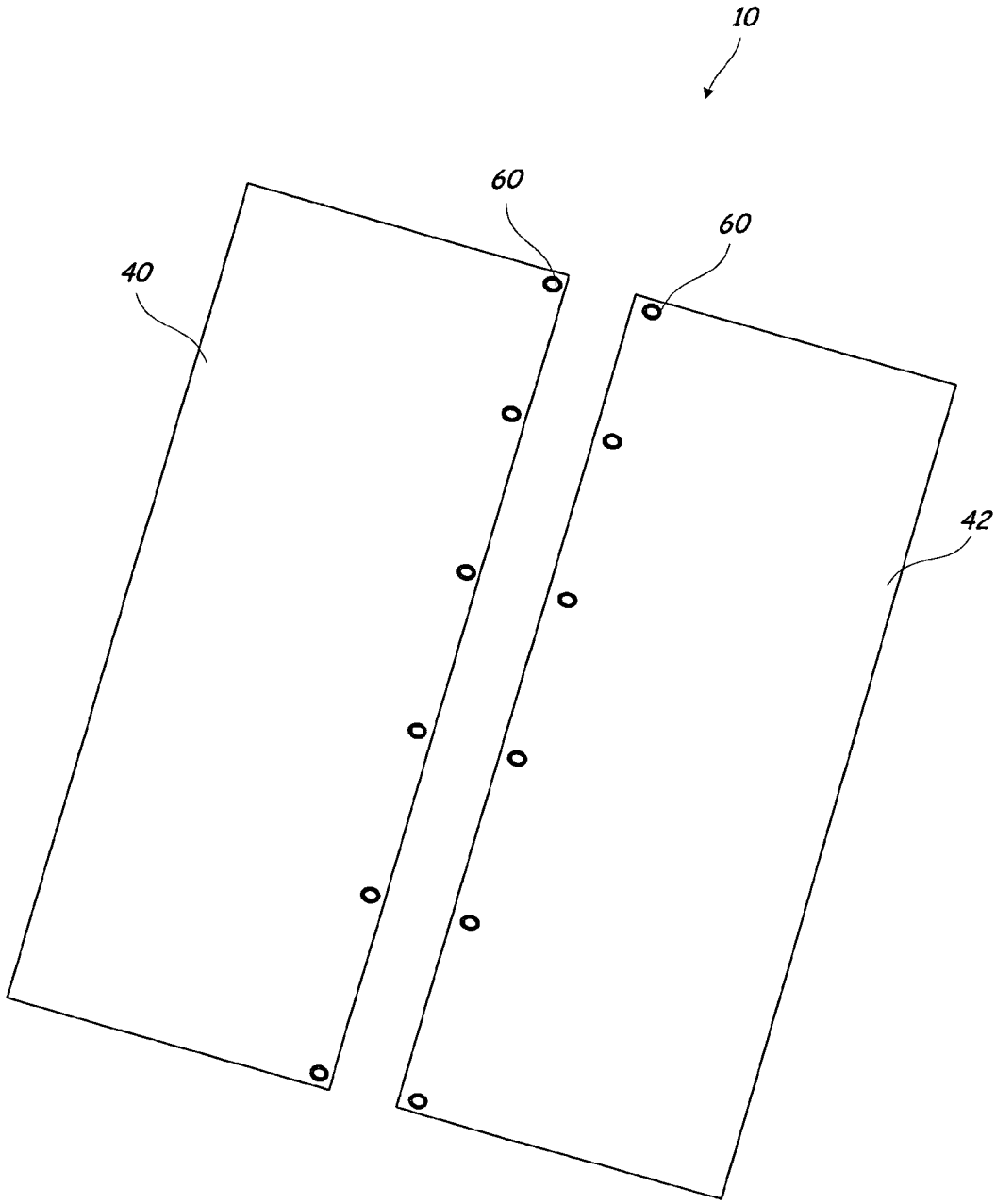
FIG. 6 is a top planar view of a clothes protector cover according to an embodiment of the present invention.

Referring now to FIG. 6, a top planar view of a clothes protector cover 10 is shown. The clothes protector cover 10 is comprised of a left sheet 40, a right sheet 42, and a plurality of grommets 60. The grommets 60 are preferably spaced apart from one another on the same sheet at a distance of fourteen inches, but they may be spaced apart at distances other than those shown. Additionally, the spacing between grommets 60 need not be uniform on the same sheet, so long as the grommets 60 are placed on one sheet in a matter that matches with the other sheet. Items of clothing on a clothes hanger 50 may be hung through the grommets 60 to help hold the clothes protector cover 10 in place or may be hung on the hanger rod 20 without being threaded through the grommets 60.

Figure 7:
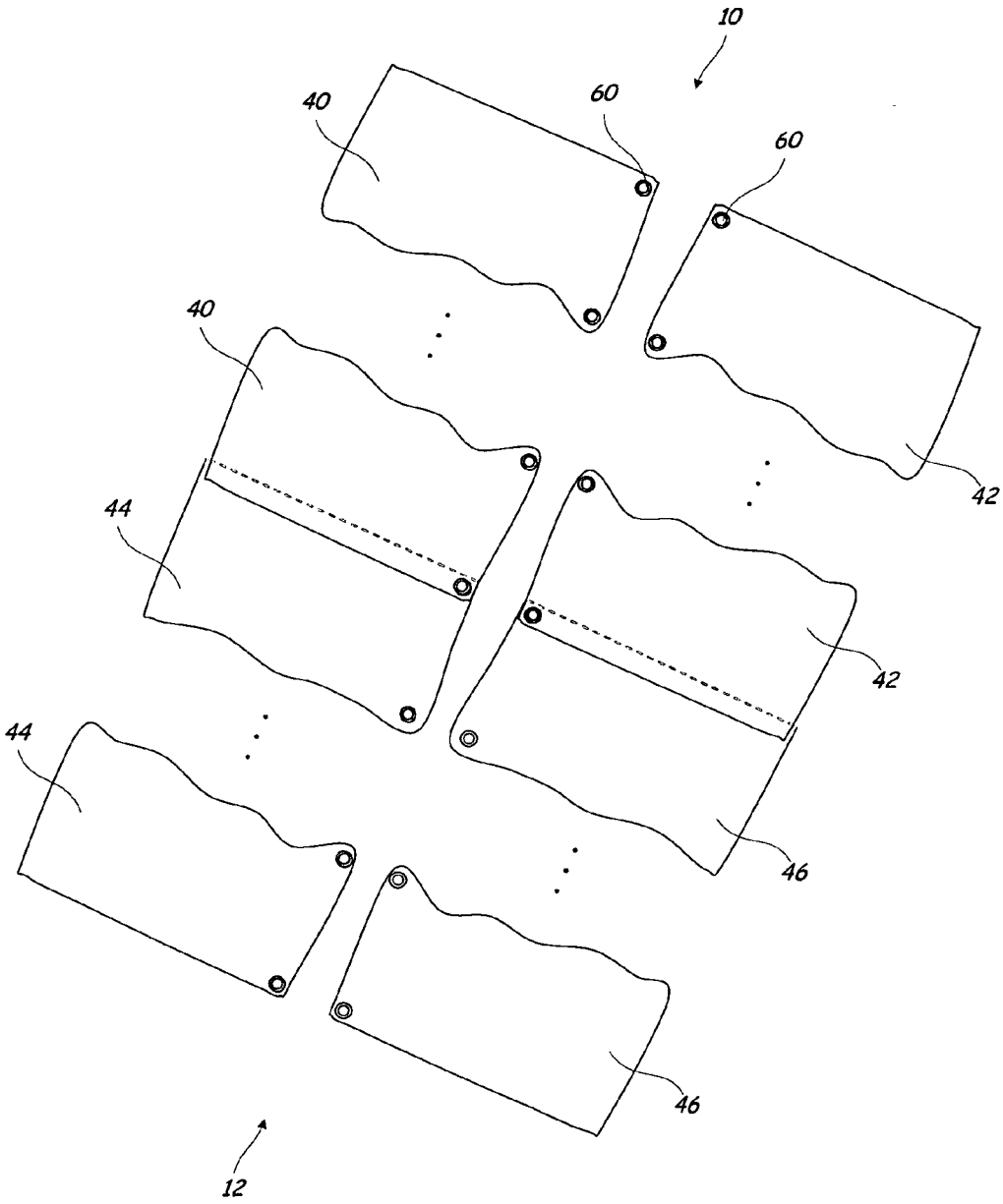
FIG. 7 is a top planar view of a clothes protector cover according to an embodiment of the present invention.

Referring now to FIG. 7, a top planar view of a clothes protector cover 10 is shown coupled to a second clothes protector cover 12. This installation accommodates closets or storage areas wherein the hanger rod is longer than the length of the left and right sheets 40 and 42 in a single clothes protector cover 10. The installation is accomplished by threading the grommets 60 of the left sheet 40 and right sheet 42 of the first clothes protector cover 10 on the same clothes hanger as the first grommets of the left sheet 44 and right sheet 46 of the second clothes protector cover 20. This installation illustrates how two clothes protector covers 10 and 12 may be joined together. However, more than two may be joined together as needed, depending on the length of the closet or storage area.

FIGS. 8 through 13 illustrate a variety of clasps that can be used to fasten together the left sheet 40 and right sheet 42 of the clothes protector cover 10. For example, these various clasps may be used when no clothes hanger 50 and associated item of clothing 30, or empty clothes hanger 50, is threaded through a pair of grommets 60 in order to hold together the left sheet 40 and the right sheet 42.

Figure 8:
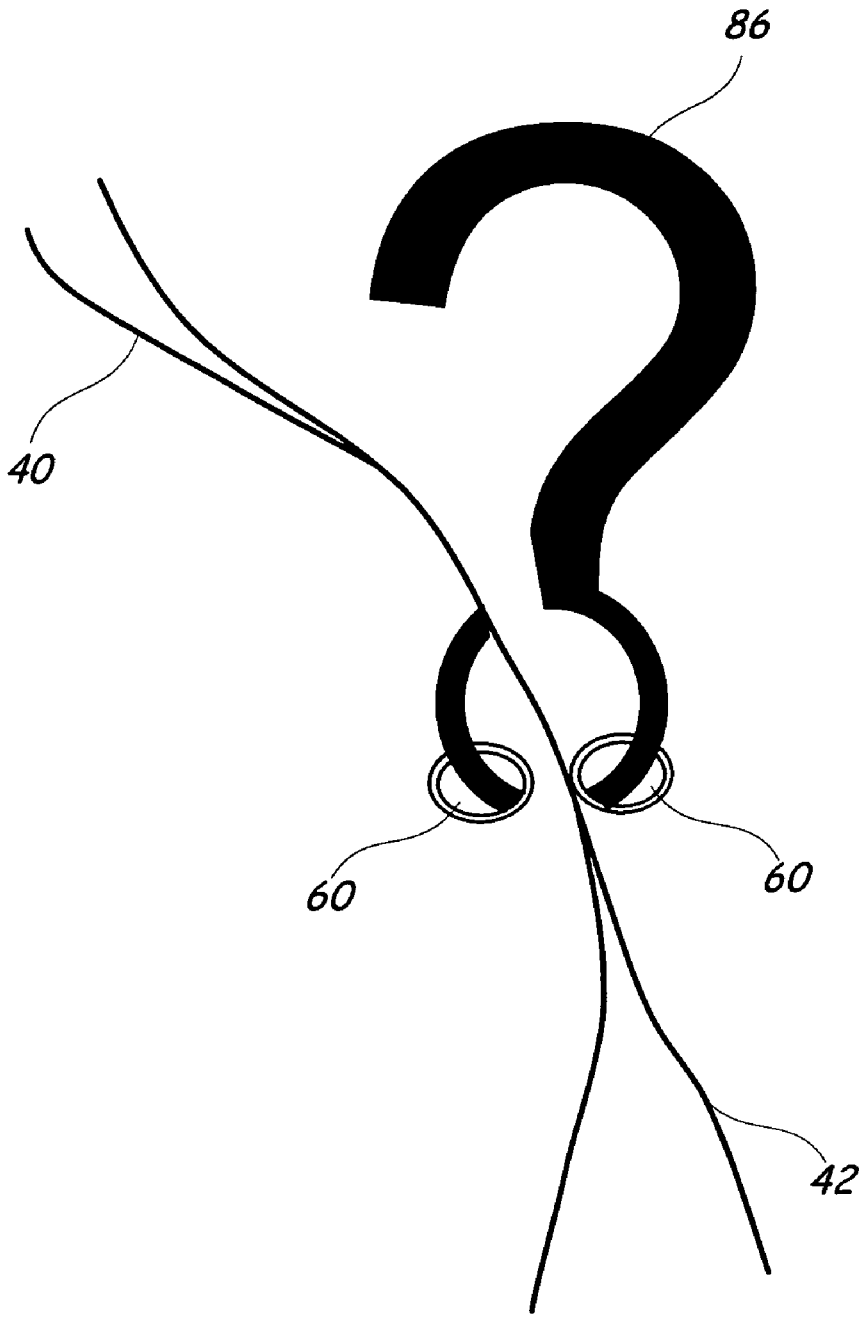
FIG. 8 is a top planar view of a clothes protector cover according to an embodiment of the present invention.

Referring now to FIG. 8, a top planar view of a clothes protector 10 is shown with a hanger hook 86. The hanger hook 86 is comprised of a top portion similar to that of a clothes hanger. The bottom portion of the hanger hook 86 is smaller and is threaded through the grommets 60 of the left and right sheets 40 and 42.

Figure 9:
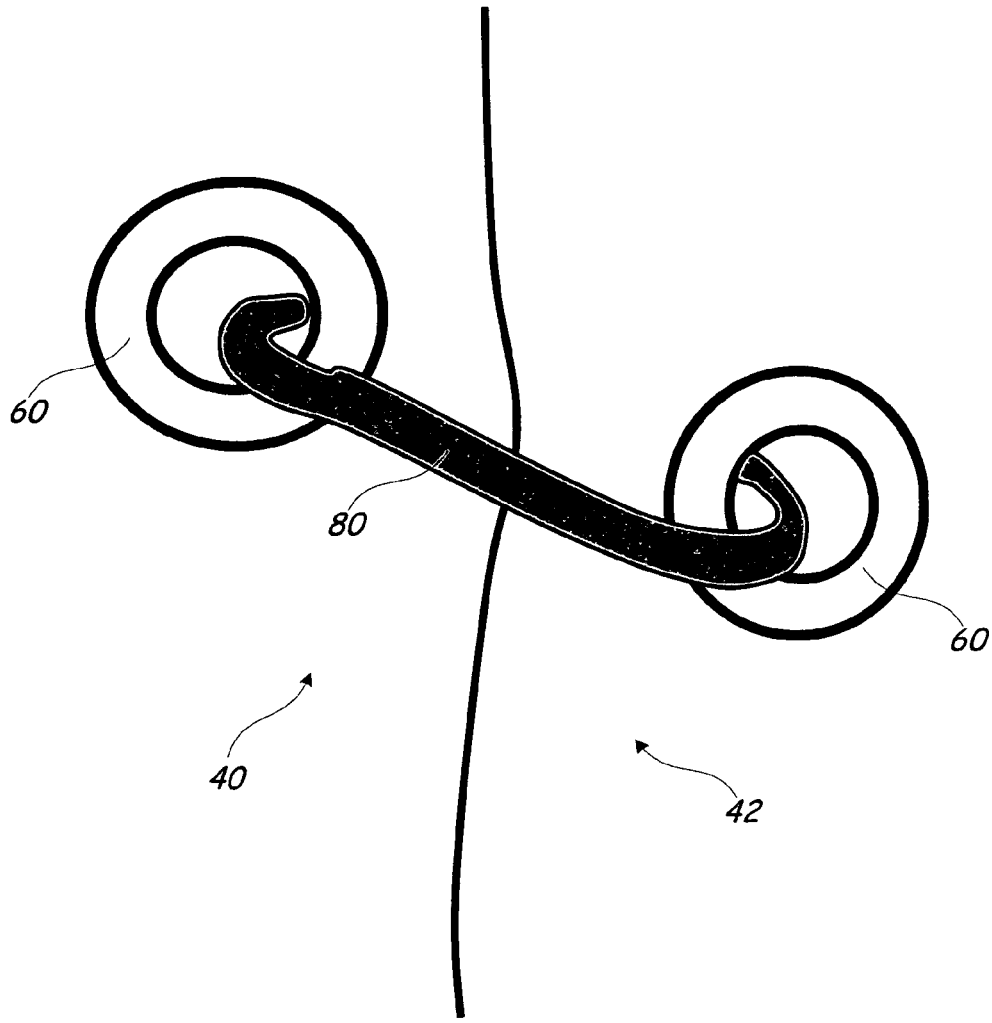
FIG. 9 is a top planar view of a clothes protector cover according to an embodiment of the present invention.

Referring now to FIG. 9, a top planar view of a clothes protector cover 10 is shown with a conventional snap hook clasp 80. The snap hook clasp 80 is threaded through the grommets 60 of the left and right sheets 40 and 42.

Figure 10:
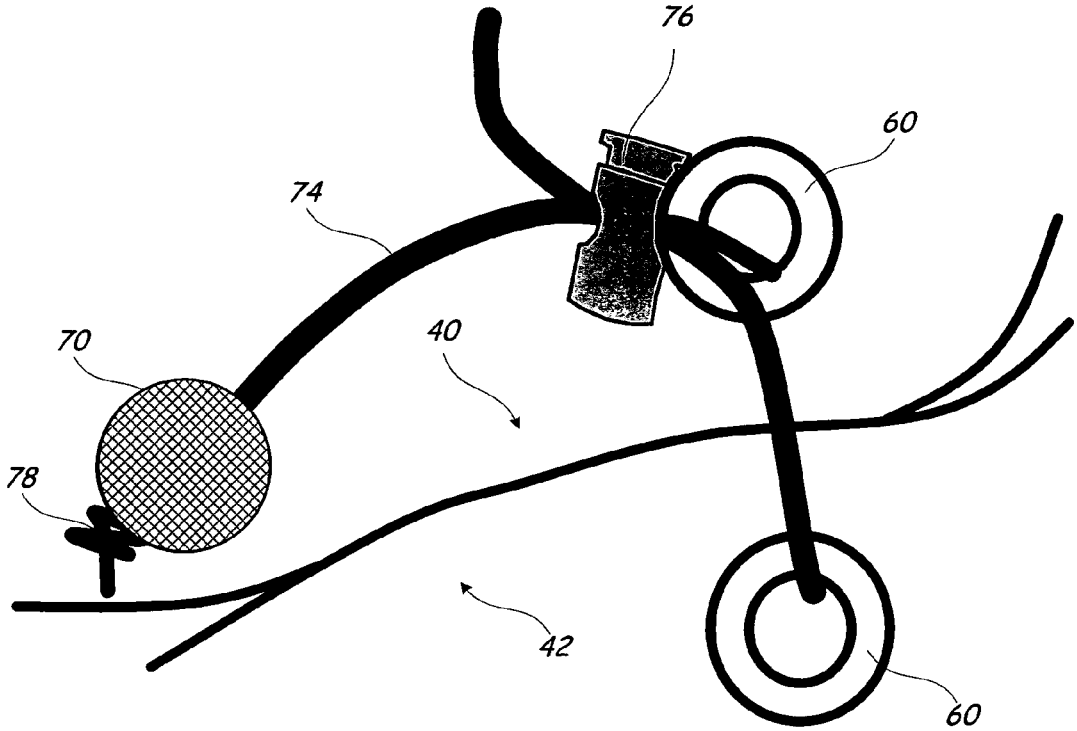
FIG. 10 is a top planar view of a clothes protector cover according to an embodiment of the present invention.

Referring now to FIG. 10, a top planar view of a clothes protector cover 10 is shown with a cord 74, cord stop 76, and cord knot 78. This illustrates yet another means by which the left sheet 40 and right sheet 42 of the clothes protector cover 10 may be held together. The cord 74, or similar material, is threaded through the grommets 60 of the left and right sheets 40 and 42 and secured with a cord stop 76. A cedar ball 70, with a narrow hole drilled through it, optionally may be used on the cord 74 and secured in place by a cord knot 78.

Figure 11:
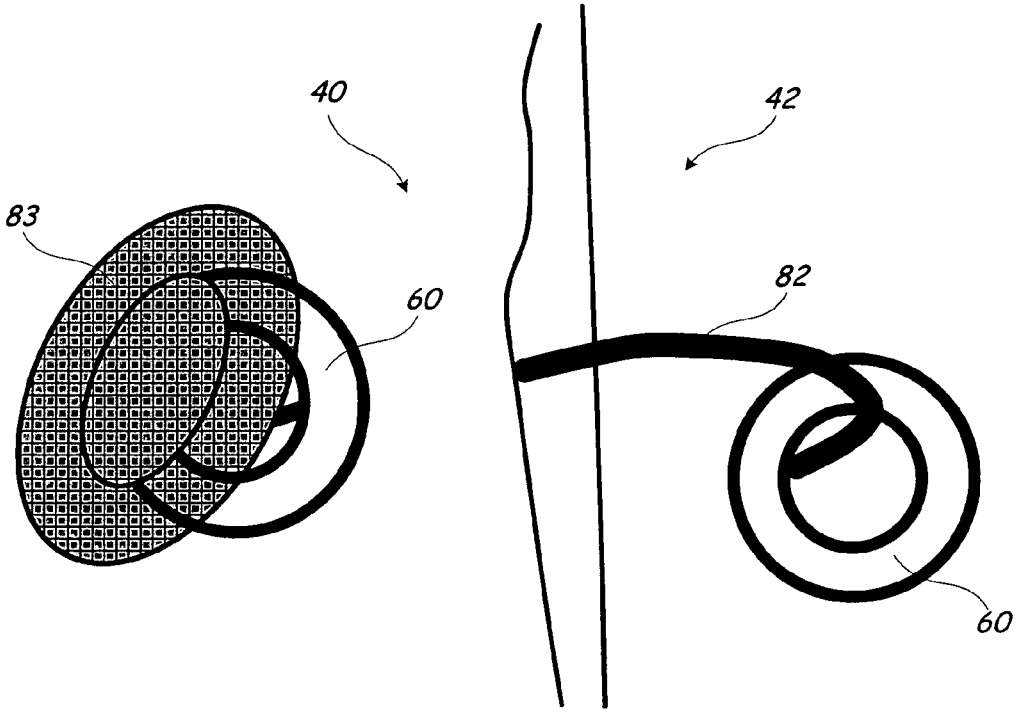
FIG. 11 is a top planar view of a clothes protector cover according to an embodiment of the present invention.

Referring now to FIG. 11, a top planar view of a clothes protector cover 10 is shown with a shower curtain hanger 82 and decorative knob 83. The shower curtain hanger 82 is available in the consumer market in many varying designs. The shower curtain hanger 82 is shaped similar to an "S" and is threaded through the grommets 60 and used to hold together the left and rights sheets 40 and 42 of the clothes protector cover 10. The shower curtain hanger 82 is adorned with a decorative knob 83. Shown here, the decorative knob 83 is a circular disk attached to the shower curtain hanger 82.

Figure 12:
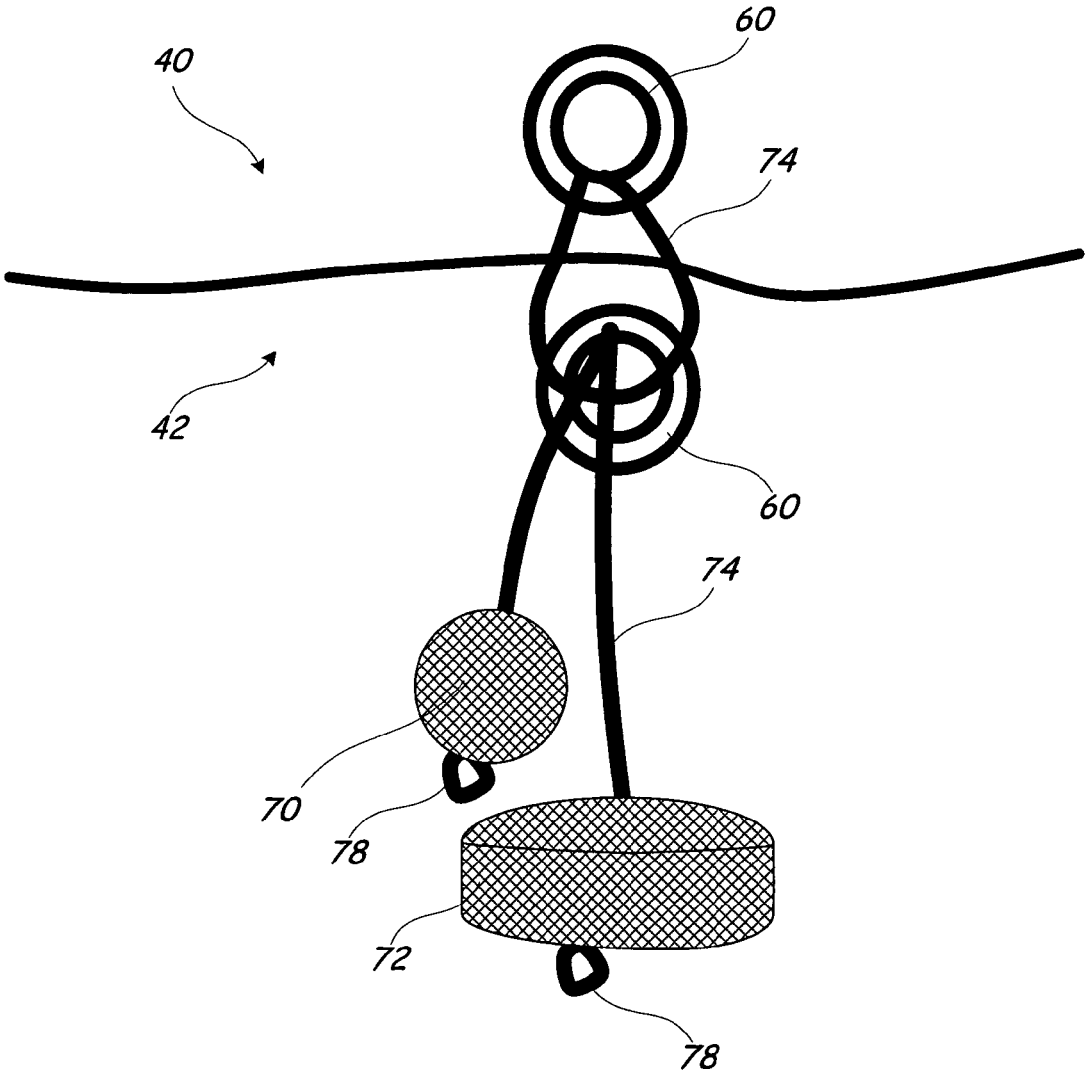
FIG. 12 is a top planar view of a clothes protector cover according to an embodiment of the present invention.

Referring now to FIG. 12, a top planar view of a clothes protector cover 10 is shown. The left sheet 40 and right sheet 42 of the clothes protector cover 10 are shown held together by the use of a cord 74, a cedar ball 70, and a cedar disk 72. A loop is formed in the cord 74 and threaded through the grommets 60 of the left and right sheets 40 and 42. The opposite ends of the cord 74 are then fed through the loop. The opposite ends of the cord 74 secure a cedar ball 70 and a cedar disk 72 in place with a cord knot 78.

Figure 13:
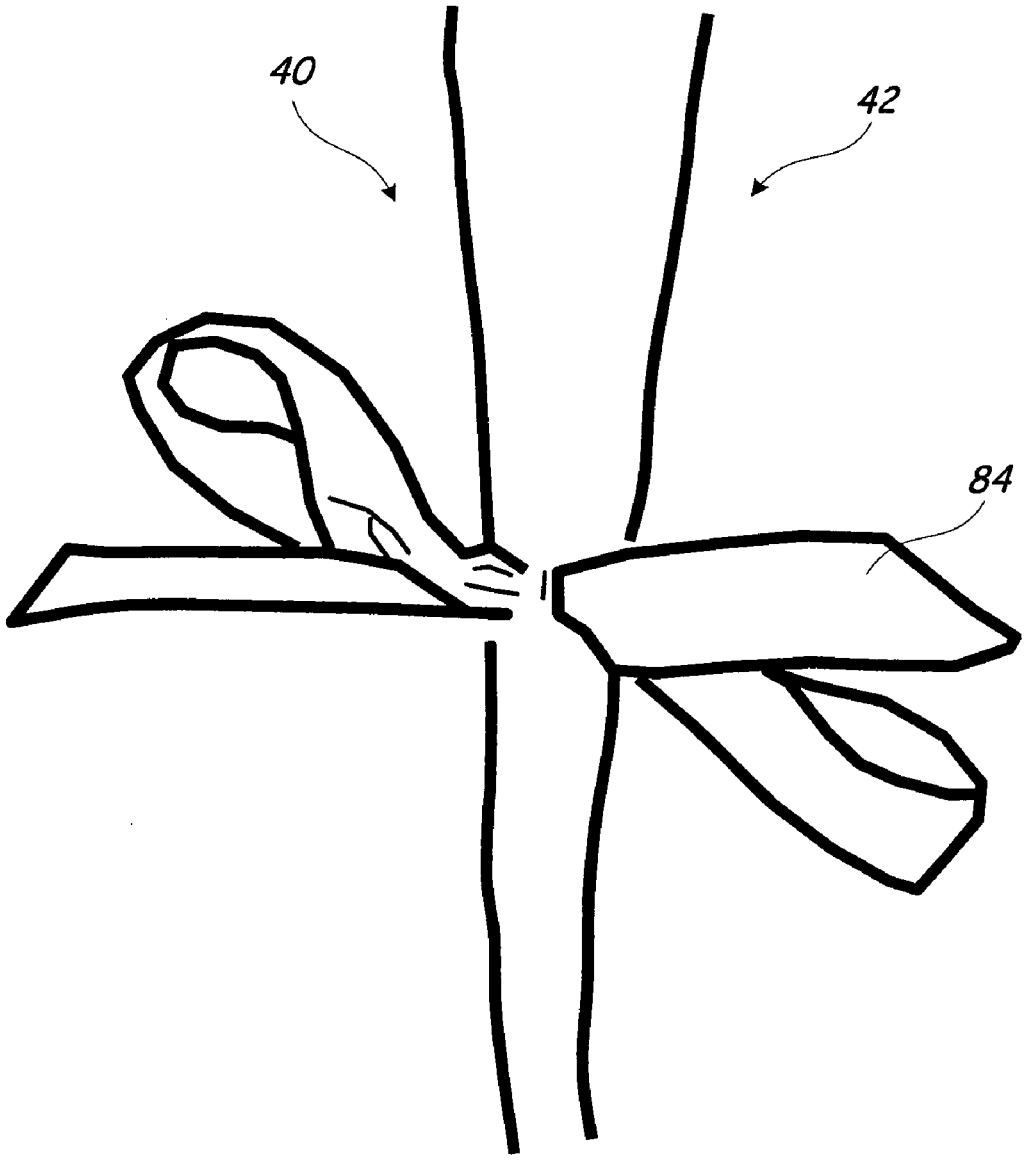
FIG. 13 is a front perspective view of a clothes protector cover according to an embodiment of the present invention.

Referring now to FIG. 13, a top planar view of a clothes protector cover 10 is shown. The left sheet 40 and right sheet 42 of the clothes protector cover 10 are shown held together by the use of a ribbon 84 tied into a bow.

Figure 14:
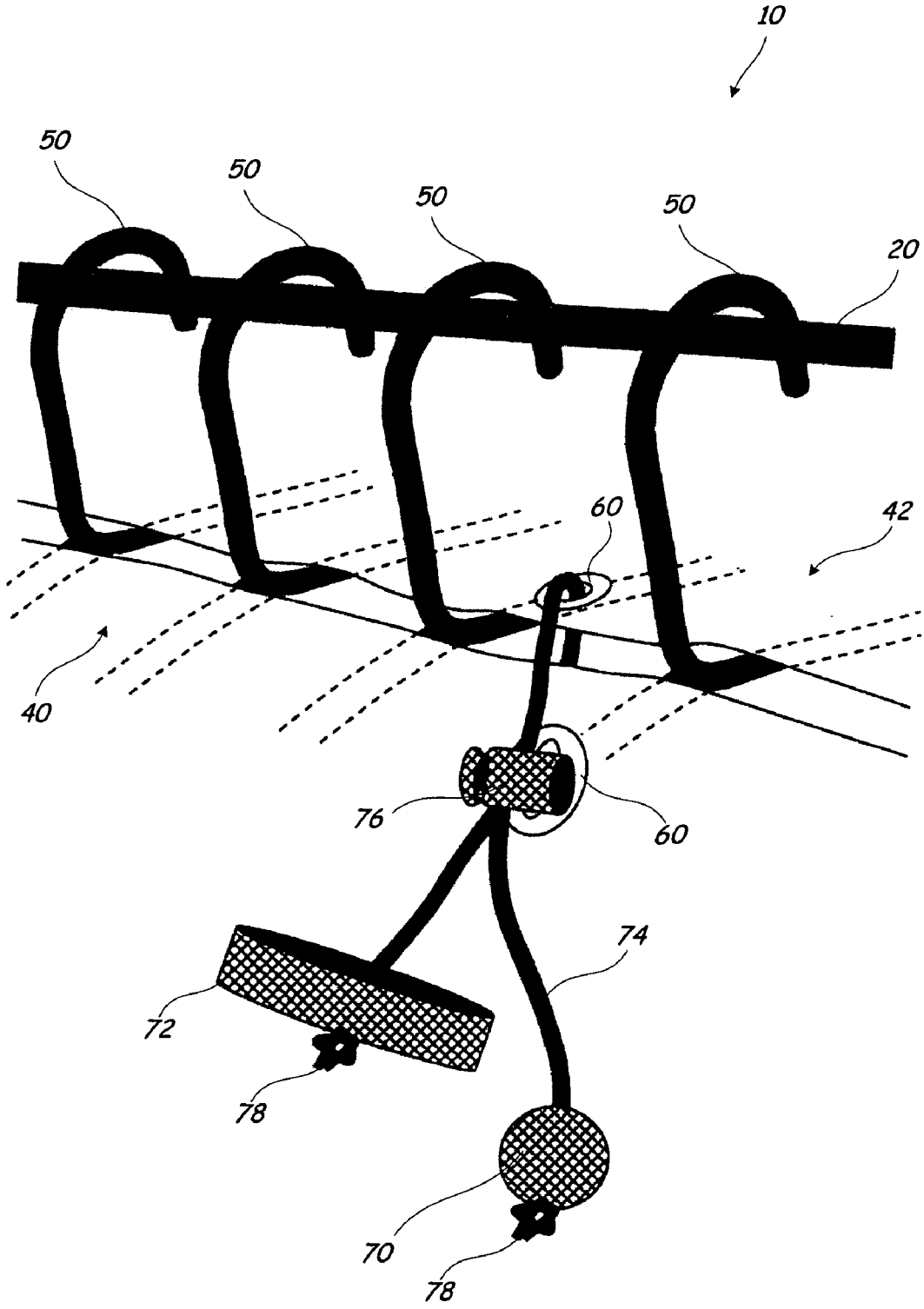
FIG. 14 is a top planar view of a clothes protector cover according to an embodiment of the present invention.

Referring now to FIG. 14, a top planar view of a clothes protector cover 10 is shown. The left sheet 40 and right sheet 42 of the clothes protector cover 10 are shown held together by the use of a cord 74, a cord stop, 76, a cedar ball 70, and a cedar disk 72. The opposite ends of the cord 74 secure a cedar ball 70 and a cedar disk 72 in place with a cord knot 78. Also illustrated are multiple clothes hangers 50 which are located between the left and right sheets 40 and 42 and under their protection from dust, but are not, however, threaded individually through the grommets 60. The grommets 60 in this figure are held together by an optional clasp and the clothes hangers 50 are placed on the hanger rod 20 intermittently between the clasps holding the left and right sheets 40 and 42 together.

Although the present invention has been illustrated and described with reference to preferred embodiments and examples thereof, it will be readily apparent to those of ordinary skill in the art that other embodiments and examples may perform similar functions and/or achieve similar results. For example: the left and right sheets 40 and 42 of the clothes protector cover 10 may be made from various materials and made to various lengths and widths, the grommets 60 of each sheet 40 and 42 may be secured together by one or more of various clasping means, and the grommets 60 may be spaced apart on each sheet 40 and 42 at varying distances. All such equivalent embodiments and examples are within the spirit and scope of the invention and are intended to be covered by the following claims.

What is claimed is:

1. A clothes protector cover, comprising:

a rectangular left sheet, wherein the left sheet is disposed about hanging items of clothing on a plurality of clothes hangers hung from a hanger bar in a closet, and wherein the left sheet covers an area from the hook portion of the clothes hanger downward over the left shoulder side of the items of clothing and extending downwardly over the left side portion of the items of clothing;

a rectangular right sheet, wherein the right sheet is disposed about hanging items of clothing on a plurality of clothes hangers hung from a hanger bar in a closet, and wherein the right sheet covers an area from a hook of the clothes hanger downward over the right shoulder side of the items of clothing and extending downwardly over the right side portion of the items of clothing;

a plurality of grommets located along the upper end and upper corners of each rectangular sheet, wherein a clothes hanger used to hang an item of clothing is threaded through a grommet on the left sheet and a corresponding grommet on the right sheet and hung on the hanger bar, and wherein the plurality of grommets are spaced apart from one another the distance of about fourteen inches; and a connecting means by which the left sheet and right sheet are joined together when not threaded with a clothes hanger.

2. The clothes protector cover of claim 1, wherein the left and right sheets are comprised of a washable fabric.

3. The clothes protector cover of claim 1, wherein the left and right sheets are hemmed on all four edges of each sheet to prevent fraying.

4. The clothes protector cover of claim 1, wherein the width of each of the left sheet and right sheet is about twenty six inches.

5. The clothes protector cover of claim 1, wherein the length of each of the left sheet and right sheet is about ninety inches.

6. The clothes protector cover of claim 1, wherein the connecting means is by the use of a plurality of snap hook clasps.

7. The clothes protector cover of claim 1, wherein the connecting means is by the use of a plurality of shower curtain hangers.

8. The clothes protector cover of claim 1, wherein the connecting means is by the use of a plurality of ribbons.

9. The clothes protector cover of claim 1, wherein the connecting means is by the use of a plurality of hanger hooks.

10. The clothes protector cover of claim 1, wherein the left and right sheets are transparent.

11. A method of fabricating a clothes protector cover comprising the steps of:

cutting a rectangular left sheet and a rectangular right sheet at a predetermined width and at a predetermined length;

punching holes along the upper edges of the rectangular sheets at a predetermined spacing of about fourteen inches;

securing grommets in each hole; and wherein the left sheet and the right sheet are joined together by a plurality of clothes hangers threaded through the plurality of grommets.

12. The method of fabricating the clothes protector cover of claim 11, further comprised of the step of:

hemming each edge of the left sheet and right sheet to prevent fraying.

* * * * *

UNITED STATES PATENT AND TRADEMARK OFFICE

CERTIFICATE OF CORRECTION

PATENT NO. : 7,600,636 B2
APPLICATION NO. : 11/328812
DATED : October 13, 2009
INVENTOR(S) : Patricia Bell It is certified that error appears in the above-identified patent and that said Letters Patent is hereby corrected as shown below:

On the Title page of the patent, Item (76) in the listing of inventor's name and address delete "P.O. Box 2998, Duluth, GA (US) 30096" and add "346 Glens Way, Woodstock, GA (US) 30188"

Column 3, line 54 of the patent, delete "dggo.0&verticle=SEARS&-sid=1009360005000450 0085&" and add "dggo.0&verticle=SEARS&-sid=10093600050004500085&".

Signed and Sealed this

Twenty-sixth Day of January, 2010

David J. Kappos

David J. Kappos
*Director of the United States Patent and Trademark Office*